US010041652B2

(12) United States Patent
Xi

(10) Patent No.: US 10,041,652 B2
(45) Date of Patent: Aug. 7, 2018

(54) LASER SPOT LIGHT WITH TWINKLING FUNCTION

(71) Applicant: Jun Xi, Dongguan (CN)

(72) Inventor: Jun Xi, Dongguan (CN)

( * ) Notice: Subject to any disclaimer, the term of this patent is extended or adjusted under 35 U.S.C. 154(b) by 76 days.

(21) Appl. No.: 15/236,439

(22) Filed: Aug. 14, 2016

(65) Prior Publication Data

US 2018/0017234 A1 Jan. 18, 2018

(30) Foreign Application Priority Data

Jul. 12, 2016 (CN) ..... 2016 2 0744193

(51) Int. Cl.

| | |
|---|---|
| ***F21V 33/00*** | (2006.01) |
| ***F21V 14/08*** | (2006.01) |
| ***F21V 29/70*** | (2015.01) |
| ***F21V 11/14*** | (2006.01) |
| *F21Y 113/13* | (2016.01) |

(52) U.S. Cl.

CPC ..... *F21V 14/08* (2013.01); *F21V 11/14* (2013.01); *F21V 29/70* (2015.01); *F21Y 2113/13* (2016.08)

(58) Field of Classification Search

CPC ..... F21V 14/08; F21V 14/085; F21V 11/16; F21Y 2115/30

USPC ..... 362/234; 353/1, 2

See application file for complete search history.

(56) References Cited

U.S. PATENT DOCUMENTS

| | | | | |
|---|---|---|---|---|
| 5,188,452 A * | 2/1993 | Ryan | F21V 9/10 | 348/E9.027 |
| 5,823,661 A * | 10/1998 | Mahanay | F21S 8/00 | 362/293 |
| 2009/0147496 A1* | 6/2009 | Sziraki | B60K 37/02 | 362/23.2 |
| 2013/0170204 A1* | 7/2013 | Sasamuro | F21V 5/04 | 362/235 |

* cited by examiner

*Primary Examiner* — Anh Mai
*Assistant Examiner* — Matthew Peerce
(74) *Attorney, Agent, or Firm* — Hemisphere Law, PLLC; Zhigang Ma

(57) ABSTRACT

The present invention provides a laser spot light with twinkling function including a laser head, a body case defining an opening, a heat radiator supporting the laser head and fixed within the body case, a light baffle configured between the opening and the laser head, a first grating has a star pattern configured between the light baffle and the laser head, a second grating has a pattern of figures configured between the first grating and the laser head, a motor, a gearbox driven by the motor and configured to drive the light baffle to rotate or translate. The light baffle defines a plurality of through holes. The laser spot light of the invention utilize a motor driving a light baffle to rotate or translate, such that the static light spots generated by the first grating are blocked and unblocked alternately, resulting a lot of twinkling light spots.

8 Claims, 4 Drawing Sheets

LASER SPOT LIGHT WITH TWINKLING FUNCTION

BACKGROUND OF THE INVENTION

1. Field of the Invention

The present invention relates to outdoor illumination devices, and more particularly to a laser spot light with twinkling function.

2. Description of Related Art

Laser spot lights are commonly classified into laser spot lights with fixed/static raster images and cartoon laser spot lights utilizing motor driving. Traditional cartoon laser spot lights use a motor driving a gear box to rotate a disk having several raster images, such that the images the laser spot light projected change in a cycle or rotate. The disadvantages of the laser spot light with fixed raster images and cartoon laser spot light both include that they have no twinkling effect, and this cause visual fatigue.

Therefore, there is a need for a laser spot light with twinkling function.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

The invention will now be described in detail through several embodiments with reference to the accompanying drawings.

Figure 1:
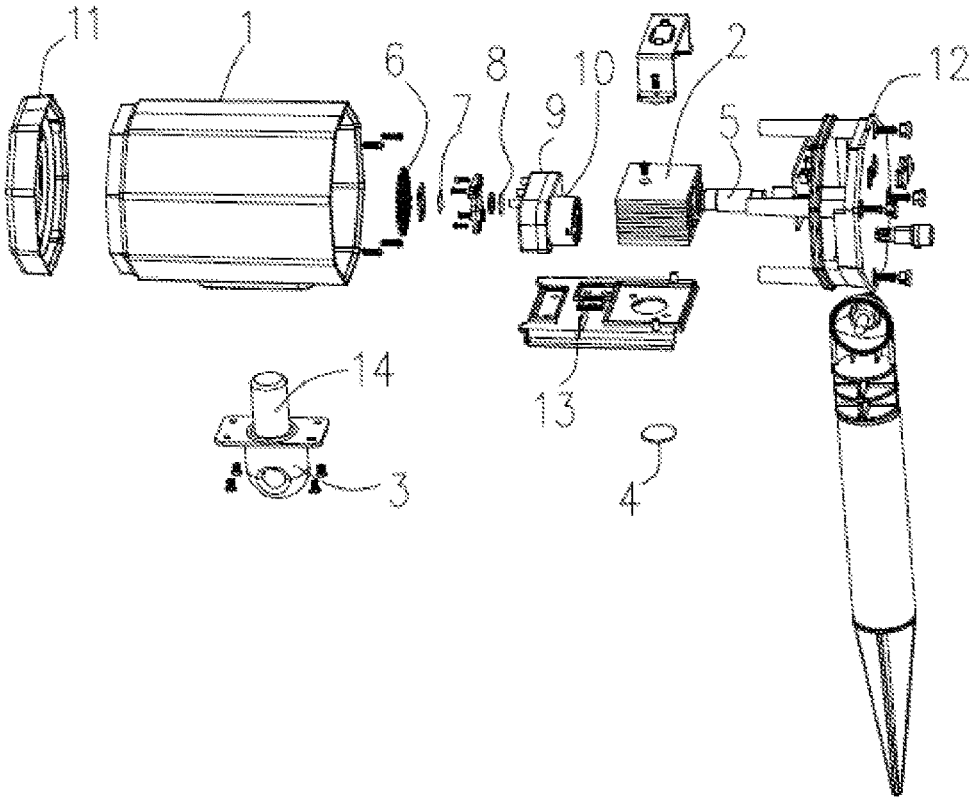
FIG. 1 is an exploded view of a laser spot light with twinkling function in accordance with an embodiment of the present invention.
Figure 2:
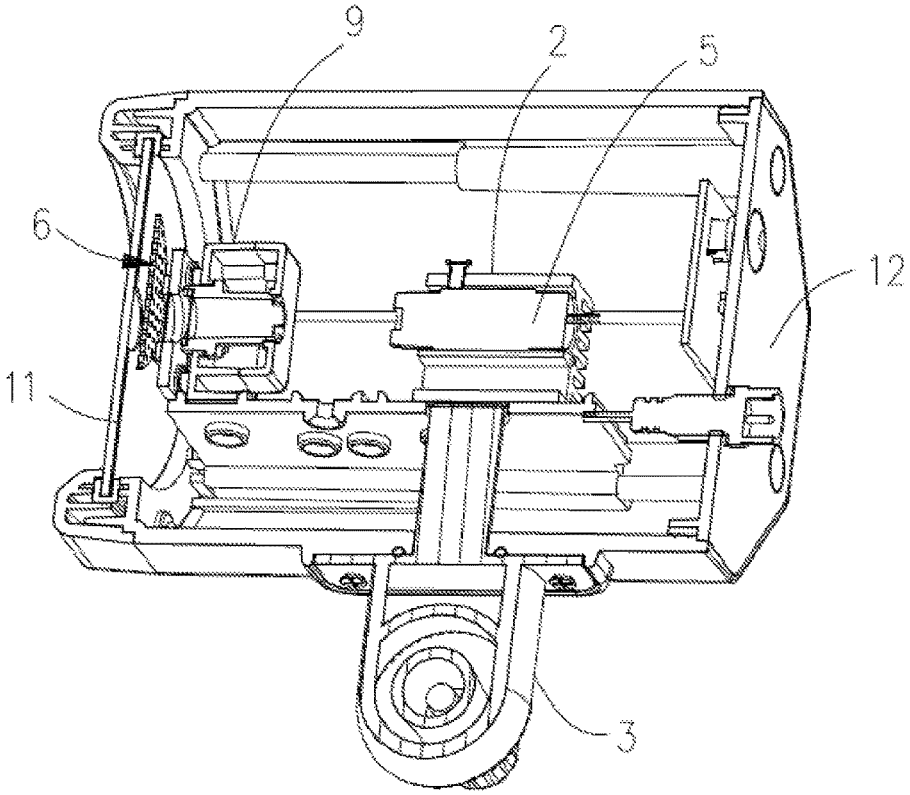
FIG. 2 is a partial cut-away view of the laser spot light.
Figure 3:
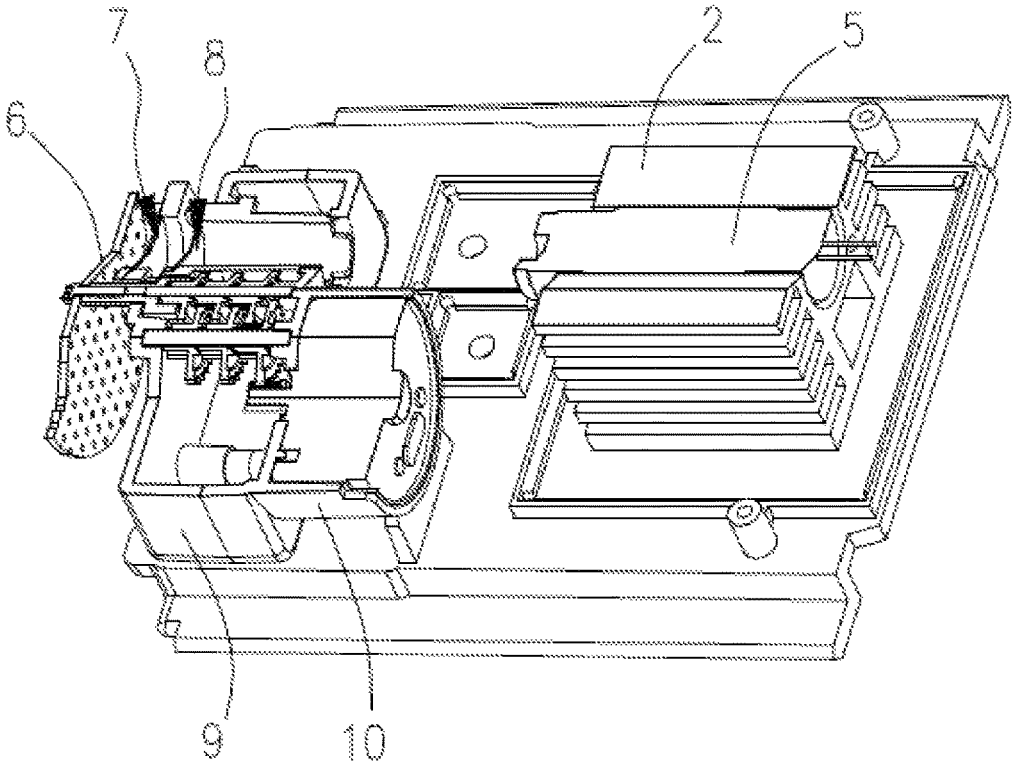
FIG. 3 is a schematic diagram of a part of the laser spot light with a part of some of the components of the laser spot light is removed.
Figure 4:
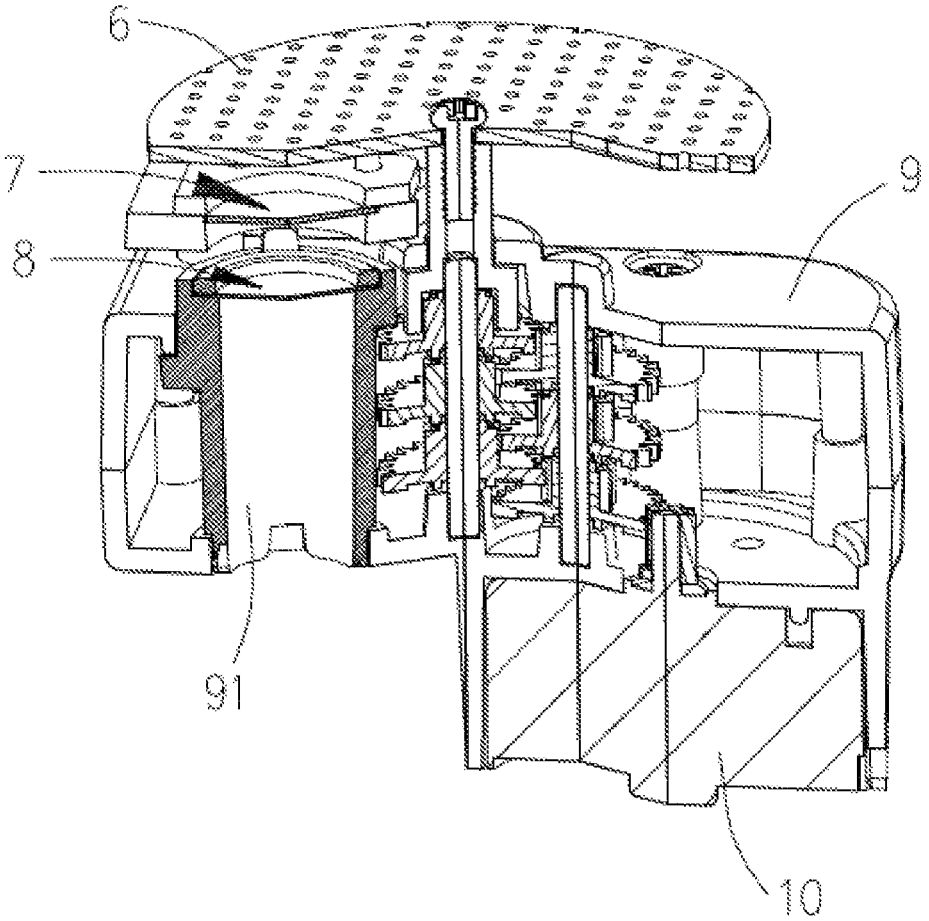
FIG. 4 is a cut-away view illustrating a part of the laser spot light in accordance with an embodiment of the present invention.

Please refer to FIG. 1 to FIG. 4, a laser spot light with twinkling function in accordance with an embodiment of the present invention maily includes a body case 1 housing a heat radiator 2, a laser head 5, a light baffle 6, a first grating 7, a second grating 8, a gearbox 9, and a motor 10. In FIG. 2, a part of the body case 1, the heat radiator 2, the laser head 5, the light baffle 6, the first grating 7, the second grating 8, and the gearbox 9 is cut away, and the motor 10 is not shown. In FIG. 3, a part of the heat radiator 2, the laser head 5, the light baffle 6, the first grating 7, the second grating 8, the gearbox 9 and the motor 10 is cut away from another view. In FIG. 4, the light baffle 6, the first grating 7, the second grating 8, the gearbox 9 and the motor 10 is cut away.

The body case 1 is substantially a hollow cylinder. An end of the cylinder defines an opening covered with a front cover 11, and the other end of the body case 1 defines another opening covered with a rear cover 12. A light transmission window is fixed on the front cover 11, a glass is mounted on the light transmission window.

The heat radiator 2 is fixed within the body case 1, for example but not limited fixed on a board 13 connected to the inner wall of the body case 1. The heat radiator 2 defines a socket or a groove used for receiving the laser head 5. Such that the laser head 5 is fixed and supported by the heat radiator 2, and the heat generated by the laser head 5 is dissipated by the heat radiator 2 to prevent overheat.

The laser spot light further includes an external cooling device 3 and a heat transmission part 14 connecting the heat radiator 2 and the cooling device 3. The cooling device 3 is set at an outside of the body case 1. The cooling device 3 may connected to the outside surface of the body case 1, and the heat transmission part 14 connected to the innerside surface of the body case 1. Heat is transmitted to the cooling device 3 from the heat transmission part 14 via the wall of the bady case 1. Particularly, a layer of heat-conducting adhesive 4 is set between the heat radiator 2 and the heat transmission part 14.

The laser head 5 may be a green laser head having a green laser emitter capable of emitting green laser beams or a red and green double tunnel laser head having a green laser emitter and a red laser emitter. The laser head may also have other laser emitters which can emitter laser beams in other colors.

The light baffle 6, the first grating 7, and the second grating 8 are sequentially set between the front cover 11 and the laser head 5. The second grating 8 has a pattern of figures, such as an angel image, and is fixedly set close to the the laser head. The second grating 8 separates the laser beam/beams outputted by the laser head 5 into several beams and the several beams form a figure/imagery corresponding to the pattern of figure of the second grating 8, like an angel imagery. The first grating 7 has a star pattern and is fixedly set between the light baffle 6 and the second grating 8. The laser beams emitted from the second grating 8 are further splited/seperated into more light beams in a larger number by the first grating 7, forming a lot of static light spots on a projecting plane existed between the first grating 7 and the light baffle 6. The lot of light spots also construct a static figure/imagery.

The light baffle 6 is moveably set close to the front cover 11. In the embodiment, the light baffle 6 is rotatably driven by the motor 10 via the gear box 9. The gear box 9 is fixed to the body case 1 and is set between the laser head 5 and the second grating 8. A through hole 91 used for permitting the light beams from the laser head 5 to pass through is define in the gear box 9. The second grating 8 may fixed on a supporting tube-shaped part received in the through hole of the gear box 9. The motor 10 is used for driving the gear box 9, and is set adjacent to the gear box 9.

The light baffle 6 defines a plurality of through holes, and the other part of the light baffle 6 is light-proof. In the embodiment, the light baffle 6 is a round panel and a density of its through holes is close to that of the light spots projected to the light baffle 6. When the light baffle 6 rotates, the light beams passed through the first grating 7 is blocked and unblocked alternatly, and the light spots radiated to an external of the body case 1 and then projected on a projecting plane are looked like twinkling stars, therefore a twinkling function is realized. Furthermore, because not all the light spots are block and unblocked at the same time, the light spots are twinkling irregularly, just like firefly flashing or twinkling stars.

In other embodiments, the light baffle 6 may be driven to translate in relative to the first grating 7. For example, the light baffle 8 moves right and left or up and down in relative to the first grating 7, and a similar twinkling function can be realized.

In the embodiment, the through holes are distributed in the light baffle 6 uniformly. In the other embodiment, the through holes can be non-uniform distribution. In other embodiment, the light baffle 6 may be semicircular or has a large cut-out and can only block a part of the light beams at a time, thus can realize a rotation twinkling stars function.

To sum up, the laser spot light of the invention utilize a motor driving a light baffle to rotate or translate, such that the static light spots generated by the first grating are blocked and unblocked alternatly, resulting a lot of twinkling light spots. Because not all the light beams are blocked and unblocked at the same time, the light spots are twinkling irregularly, can not cause visual fatigue.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A laser spot light with twinkling function, comprising:

a laser head;

a body case defining an opening thereof;

a heat radiator supporting the laser head and fixed within the body case;

a light baffle moveably configured between the opening and the laser head;

a first grating having a star pattern, fixedly configured between the light baffle and the laser head;

a second grating having a pattern of figures, fixedly configured between the first grating and the laser head, and configured for separating the light outputted by the laser head into several beams and the several beams forming a figure/imagery corresponding to the pattern of figure of the second grating;

a motor;

a gearbox driven by the motor and configured to drive the light baffle to rotate or translate relative to the first grating;

wherein the laser beams emitted from the second grating are further separated into more light beams by the first grating;

wherein the light baffle defines a plurality of through holes permitting the laser beams emitted from the first grating to pass through and form light spots, and a density of the through holes is similar to that of the laser beams projected to the light baffle; wherein the light baffle is configured to rotate so that the laser beams passed through the first grating are blocked and unblocked alternately, the laser spot light is configured to emit the light spots to an external of the body case to be projected onto a projecting plane and form the appearance of twinkling stars.

2. The laser spot light of claim 1, wherein the laser head comprises at least one laser emitter.

3. The laser spot light of claim 1, wherein the through holes are distributed in the light baffle uniformly.

4. The laser spot light of claim 1, wherein the gear box is configured between second grating and the laser head, a through hole is defined in the gear box and is configured for permitting light beams emitted from the laser head to pass through and reach the second grating.

5. The laser spot light of claim 1, wherein the light baffle is configured adjacent to the opening.

6. The laser spot light of claim 1, wherein the heat radiator defines a socket configured for receiving the laser head and configured for dissipating heat generated by the laser head.

7. The laser spot light of claim 6, further comprising a cooling device and a heat transmission part connecting the heat radiator and the cooling device; the cooling device is configured at an outside of the body case.

8. The laser spot light of claim 7, wherein a layer of heat-conducting adhesive is configured between the heat radiator and the heat transmission part.

* * * * *